US006386476B1

(12) United States Patent
Adleman, Jr.

(10) Patent No.: US 6,386,476 B1
(45) Date of Patent: May 14, 2002

(54) FLOOR COVERING REMOVAL TOOL

(76) Inventor: G. Kenneth Adleman, Jr., 1221 13 Rd., Loma, CO (US) 81524

( * ) Notice: Subject to any disclaimer, the term of this patent is extended or adjusted under 35 U.S.C. 154(b) by 0 days.

(21) Appl. No.: 09/592,825

(22) Filed: Jun. 13, 2000

(51) Int. Cl.[7] ..... B65H 19/28

(52) U.S. Cl. ..... 242/532.5; 242/532.6; 242/586.5; 242/587.2; 156/584

(58) Field of Search ..... 242/532.5, 532.6, 242/586, 586.2, 586.3, 586.4, 586.5, 587.2, 587.3; 156/344, 584

(56) References Cited

U.S. PATENT DOCUMENTS 600,852 A * 3/1898 Baisley
649,694 A * 5/1900 Hunter
761,751 A * 6/1904 Barrett
4,346,856 A * 8/1982 Paietta
4,605,179 A * 8/1986 Arbter
4,640,735 A * 2/1987 Murray et al.
4,880,181 A * 11/1989 Drahanowsky
5,388,782 A * 2/1995 King
5,785,272 A * 7/1998 Slade et al.
6,004,426 A * 12/1999 Johnson
6,199,616 B1 * 3/2001 Gillespie

FOREIGN PATENT DOCUMENTS

GB 21271 A * 10/1898 ..... 242/532.5

* cited by examiner

*Primary Examiner*—William A. Rivera
(74) *Attorney, Agent, or Firm*—Edwin L. Hartz

(57) ABSTRACT

A floor cover removal tool having a rigid roller of substantially cylindrical shape with an internal clamp for holding the end of the floor covering being removed.

10 Claims, 10 Drawing Sheets

FLOOR COVERING REMOVAL TOOL

BACKGROUND OF THE INVENTION

1). Field of the Invention

This invention relates to the removal of floor covering, such as, e.g., carpet or vinyl, adhesively secured to a substrate of a floor or stairs and more particularly to a rugged, easy to use tool for removing the floor covering.

2). Related Art

Floor covering, such as carpet or vinyl, is often glued to a substrate such as wood or concrete. The removal of floor covering and particularly carpet adhesively secured to a substrate has been addressed in a number of U.S. Patents. Various devices or tools have been disclosed and are in use today. These devices tend to be bulky, expensive and often take considerable time to set up for operation.

The following U.S. Patents disclose various devices for removal of adhesively secured floor covering: U.S. Pat. Nos. 4,332,371, 4,394,052, 4,533,118, 4,560,146, 4,906,323, 4,948,451, 5,348,608, 5,387,308, 5,454,899, 5,456,794, 5,505,433, 5,720,844, and 6,004,426.

At least two of these patents disclose a carpet removal device where the removed carpet is rolled up on a spool. In U.S. Pat. No. 4,394,052 ('052 patent) the carpet removal device includes a blade that is pulled forward under the carpet being removed to wedge beneath the carpet to separate the carpet from the floor. In one embodiment, the winding of the carpet up on the spool causes the device to move forward to wedge the knife beneath the carpet. A free end of the carpet is attached to the spool. (The method of attaching is not disclosed). The spool has four longitudinal bars or spool crossbars on which the carpet is wound.

The device of the '052 patent is relatively heavy, cumbersome and expensive. Also it has been found that the blade of carpet removal devices digs into the substrate and gets stuck in wooden substrate. Additionally, these blades do not stay sharp in use. A further problem with bulky devices, such as the one disclosed in the '052 patent is that they require a large area in which to maneuver. Also, these devices are not useful in removing floor covering from stairs or confined areas.

Other devices employing a spool are disclosed in U.S. Pat. No. 6,004,426 ('426 patent). A blade is not used in the devices of the '426 patent and the carpet is pulled up by being wound on a rotating spool. The end or edge of the carpet to be removed is attached to the spool. In the preferred embodiment the means for attaching the edge of the carpet to the spool member is a plurality of tooth members extending outwardly from the spool member that are laterally aligned between the ends of the spool member to form a row of tooth members. Other means for attaching the edge of the carpet to the spool member are disclosed. The other means for attaching include a relatively strong tape, clips attached to the spool member, and tapped holes in the outer surface of the spool member through which sharpened screws can be cooperatively inserted after penetrating a portion of the carpet, with the screws holding the floor covering to the spool member.

The preferred means for attachment of the '426 patent has many problems in practice. A first problem is one of safety in that the sharp and pointed teeth can tear up the hands of the user. Additionally, it has been found that the teeth break off because of the torque that occurs in pulling up the carpet while rolling it on the spool.

SUMMARY OF THE INVENTION

The problems of the prior devices for removing floor covering, such as carpet or vinyl, adhesively secured to a floor or stairs are overcome by the simple tool of the invention. The tool consists of a cylindrical roller formed from two parts that are hinged together and that have an opening or slit through which the end of the floor covering is inserted. A member attached to the inside surface of one part pushes the floor covering against a similar member attached to the inside surface of the other part or against the inside surface of the other part to hold the floor covering in place while rotating the roller to take up the floor covering.

The roller is made of relatively heavy material to give the cylindrical body of the tool rigidity and to provide a secure grip on the end of the floor covering in the initial stages of pulling up the floor covering and rolling it on the roller.

The roller may be manually rotated or rotated by a motor. For rotation, a coupler extends from one or both ends of the cylindrical portion of the roller. The coupler has a shaped hole for receiving a correspondingly shaped shaft of the drive mechanism. For manual rotation, a lever arm has a shaft extending at a right angle at one end to engage the coupler of the roller. Advantageously, the same end of the lever arm includes a ratcheting mechanism for ratcheting the arm back into a position to further rotate the roller of the tool.

Alternatively, a motor drive with an adaptor at the end of the motor shaft to accommodate the shape and depth of the coupler at the end of the roller may be employed. The motor has a carriage that is placed under the motor to carry the motor as it moves while rotating the roller of the tool. The carriage is attachable to either side of the motor for rotation of the tool in either direction.

Objects, features and advantages of this invention will become apparent from a consideration of the description, the appended claims and the accompanying drawing.

DESCRIPTION OF PREFERRED EMBODIMENTS

Figure 1:
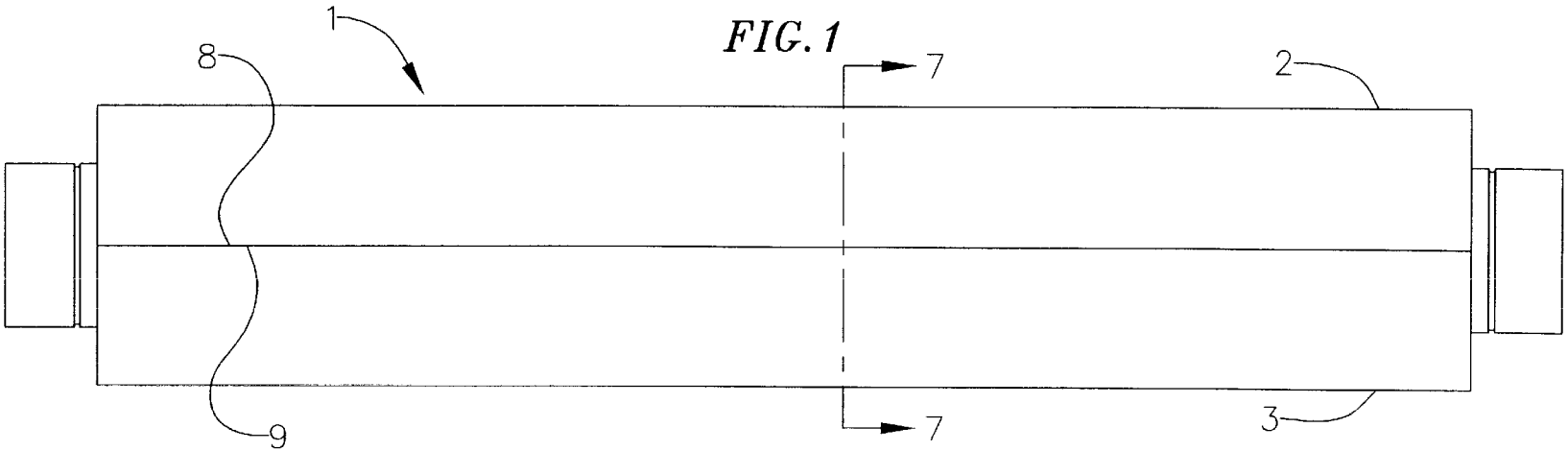
FIG. 1 is a top plan view of the roller of the floor covering removal tool in a fully closed position in accordance with this invention.

The roller 1 of the tool for removing floor covering, such as carpet, that has been adhesively attached to a substrate has a rigid body, preferably made of steel. The invention will be disclosed with carpet, but is also useful for removing vinyl. Roller 1 has a first part 2 and a second part 3 held together by a hinge 4. As seen best in FIGS. 4–7, part 2 and part 3 are essentially half cylinders joined along edge 5 and edge 6, respectively, by hinge 4 and form a substantially cylindrical body when closed together. When fully closed, as shown in FIGS. 1–3 and 7, edge 8 of the first part 2 and edge 9 of the second part meet in a line 7 that is diametrically opposite the hinge 4. An opening 10 between parts 2 and 3 along the edges 8 and 9 is formed when the parts are opened for insertion of the end of the floor covering.

Figure 7:
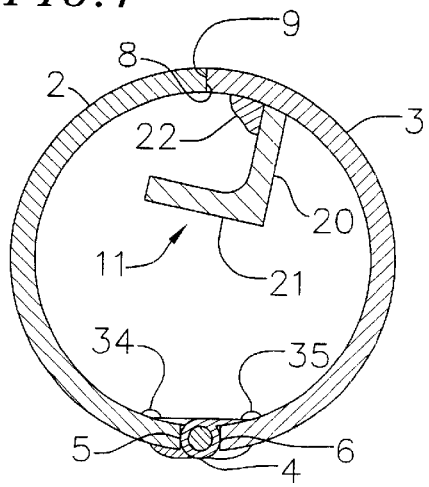
FIG. 7 is a cross-sectional view of the roller along the section lines 7—7 of FIG. 1 in accordance with this invention.
Figure 7A:
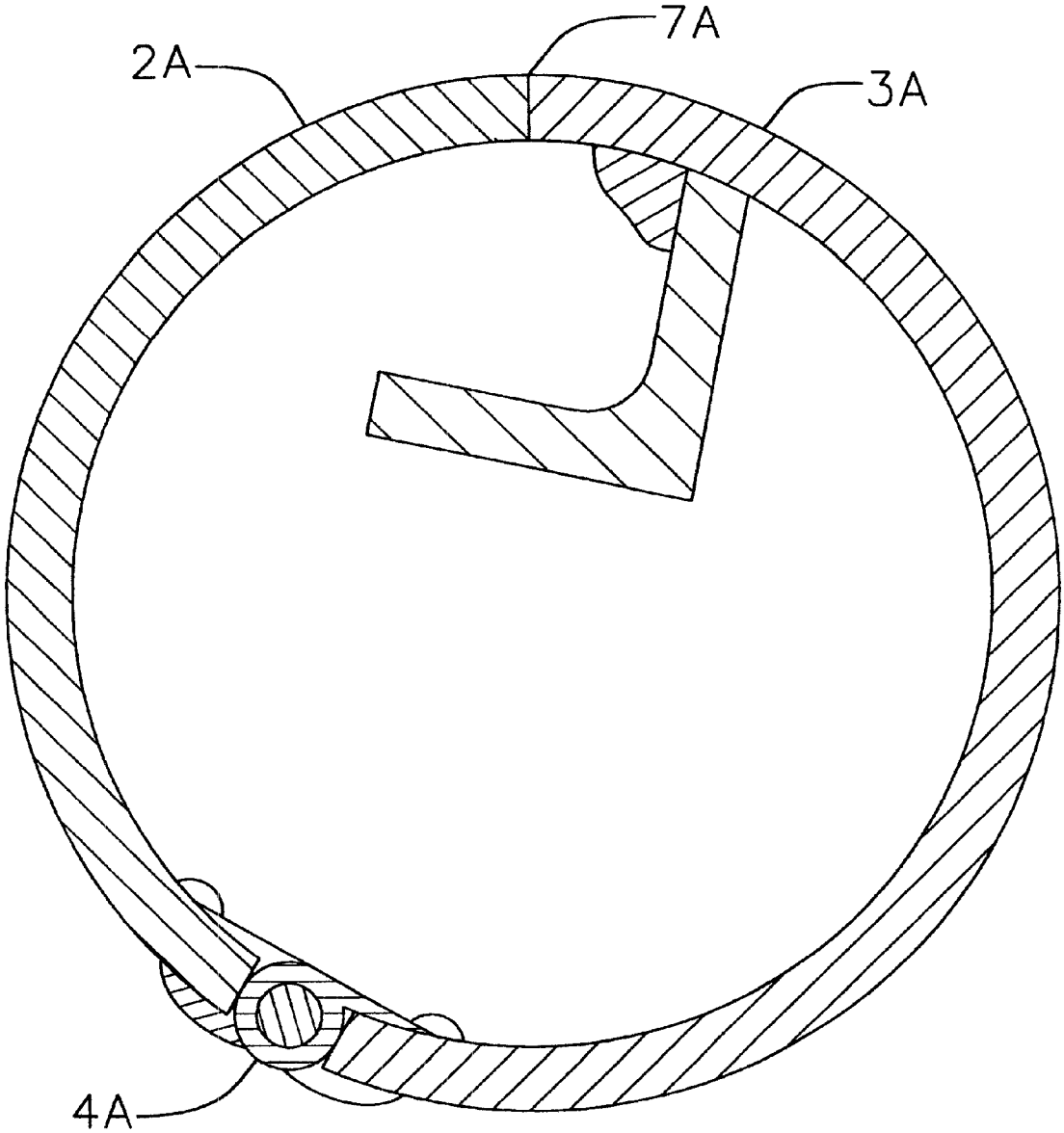
FIG. 7A is a cross-sectional view of an alternative embodiment of a roller wherein one part of the cylindrical body is larger than the other part of the cylindrical body in accordance with this invention.

In the embodiment of the drawings, the two parts joined by a hinge are identical. Each is essentially a half cylinder. Alternatively, one part 2A can be larger than the other part 3A and the greater part of the cylinder as shown in FIG. 7A. The hinge 4A joining the parts will then not be diametrically opposite the line 7A as shown in the drawings.

Figure 6:
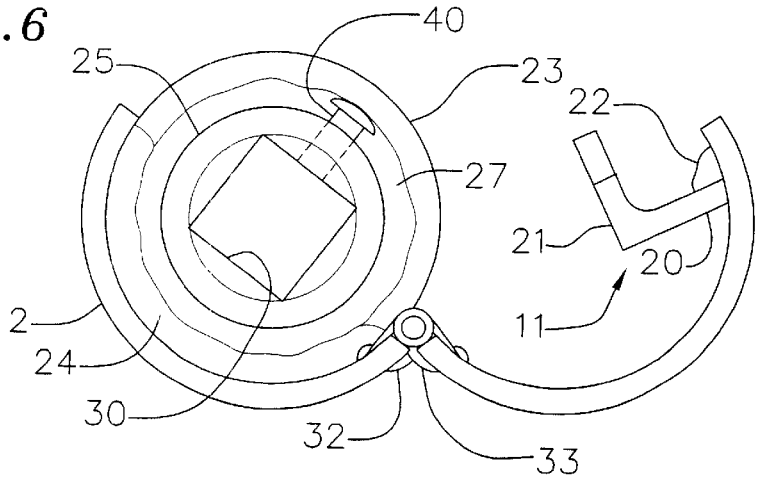
FIG. 6 is a left end elevation view of the roller of FIG. 4 in accordance with this invention.
Figure 8:
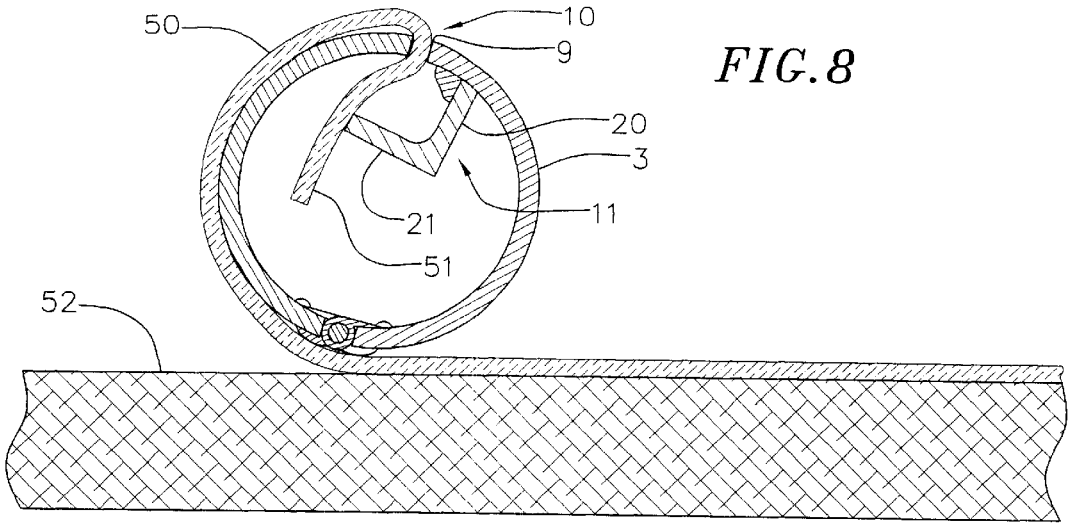
FIG. 8 is a cross-sectional view of the roller along section line 7—7 of FIG. 1 with an end of floor covering to be removed locked in place in accordance with this invention.

The roller 1 has an internal means for gripping or holding the end of the floor covering in place while it is being rolled on the roller 1. As shown in FIG. 8 the second part has a longitudinally extending clamp 11 welded to the inside of the part near the edge 9. Clamp 11 has two arms 20, 21 at right angles, with arm 20 being welded to the second part 3 by a welding bead 22 as shown in FIGS. 6 and 7.

Figure 3:
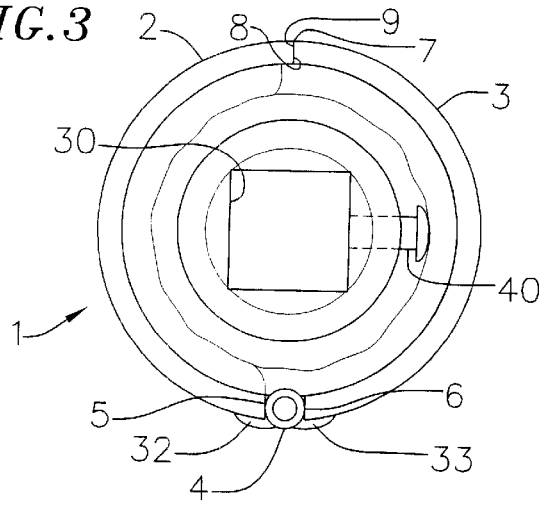
FIG. 3 is a left end elevation view of the roller of FIG. 1 in accordance with this invention.

Roller 1 further includes solid discs 23 at each end of the roller for coupling or attaching a drive mechanism to the roller. The disc 23 is preferably made from a rigid material such as steel and is attached to the first part 2 by welding, as shown by weld bead 24 to form a closed end at each end of the cylinder. A coupler 25 for connecting the roller to a drive mechanism is attached to the disc 23 by a weld bead 27. The coupler 25 has a hole 30 that has a selected shape, such as a square, as shown in FIGS. 3 and 6.

Figure 2:
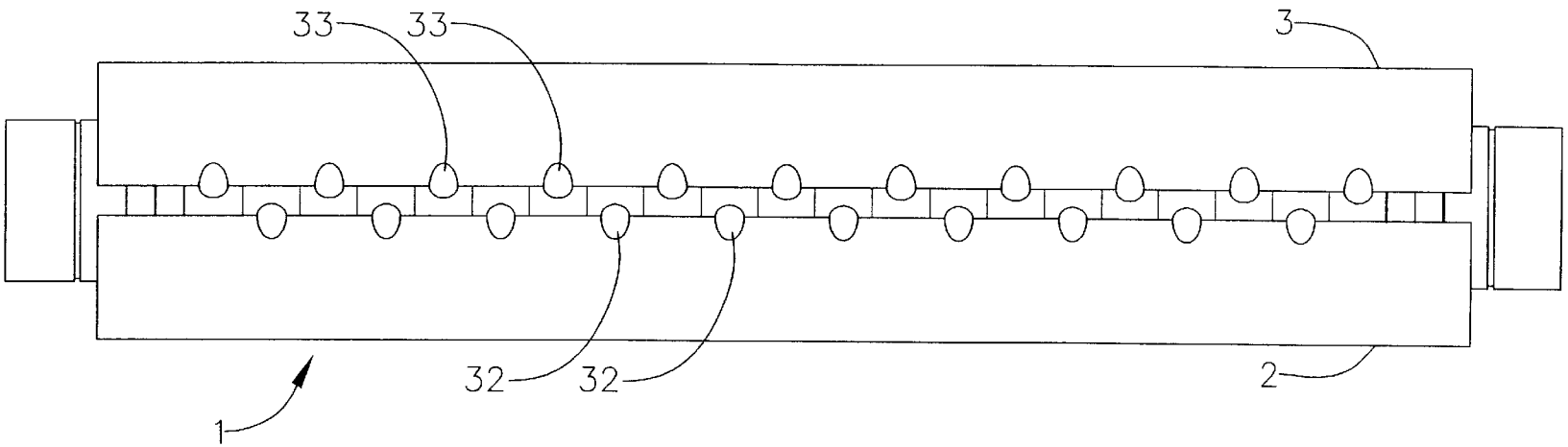
FIG. 2 is a bottom plan view of the roller in a filly closed position in accordance with this invention.
Figure 4:
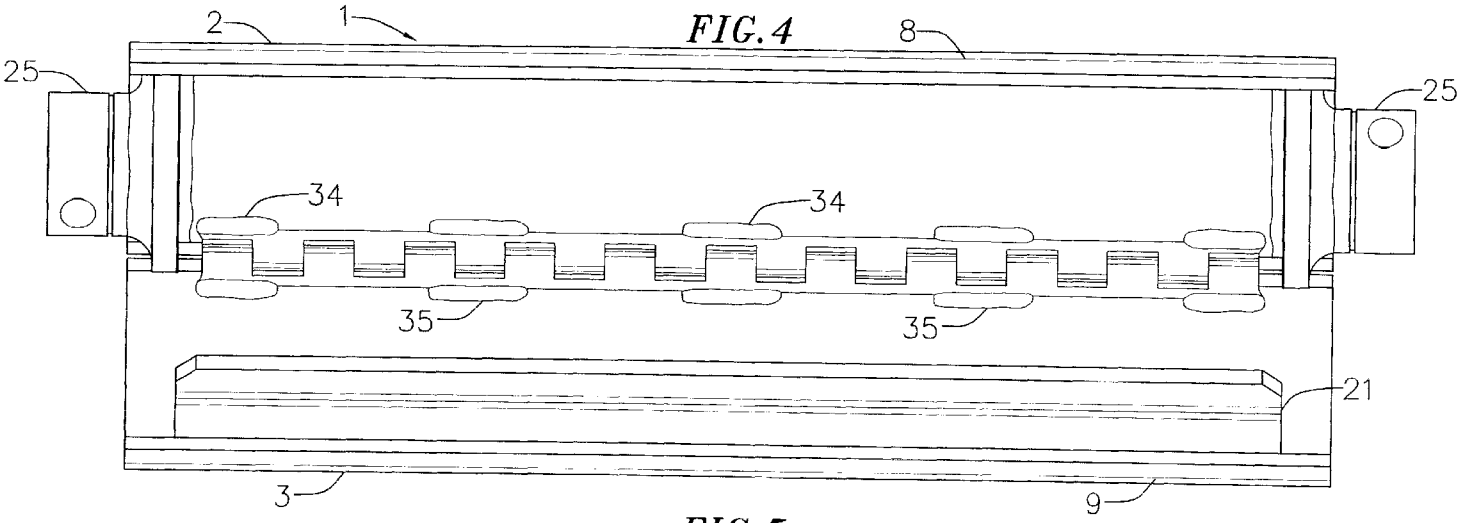
FIG. 4 is a top plan view of the roller of the floor covering removal tool in a fully open position in accordance with this invention.
Figure 5:
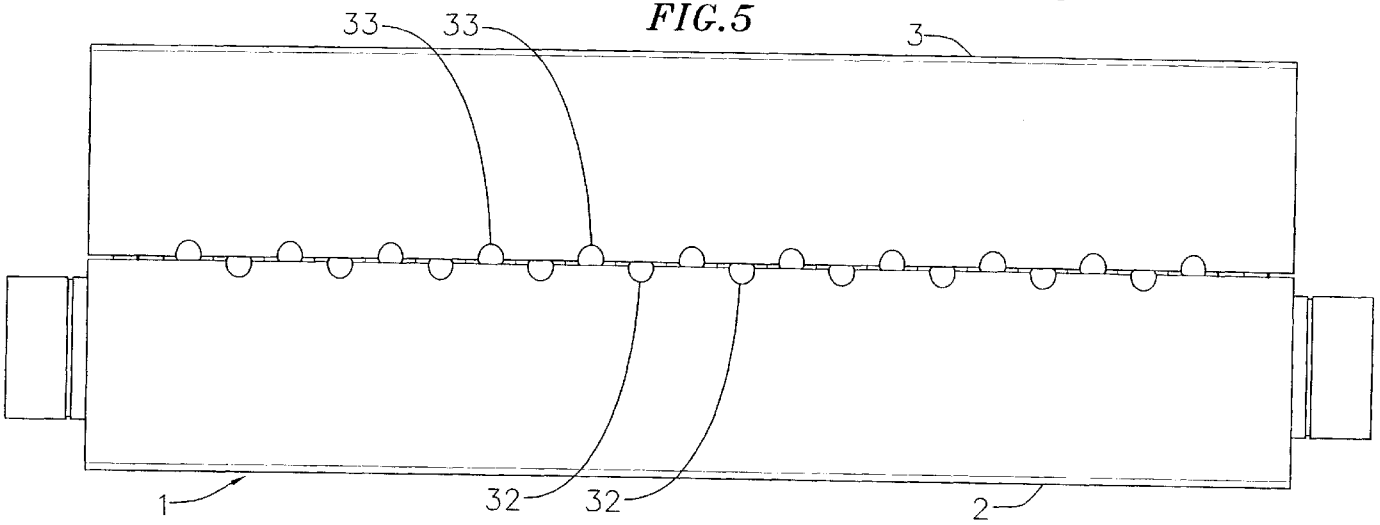
FIG. 5 is a bottom plan view of the roller in a fully open position in accordance with this invention.

The hinge 4 is a continuous longitudinal hinge, similar to a piano hinge, and is welded to the first part 2 and the second part 3 as shown in FIG. 2 by the weld spots 32 on part 2 and the weld spots 33 on part 3. The hinge 4 is also welded internally and is welded to the first part 2 by weld spots 34 and to the second part 3 by weld spots 35, as shown in FIG. 4.

The coupler 25 has a pin 40 that extends into the hole 30 to secure the drive mechanism in place when in position on the tool. The coupler 25, as best seen in FIGS. 1, 2, 4, and 5 extends out beyond the cylindrical portion of the tool for attachment to the drive mechanism.

Figure 9:
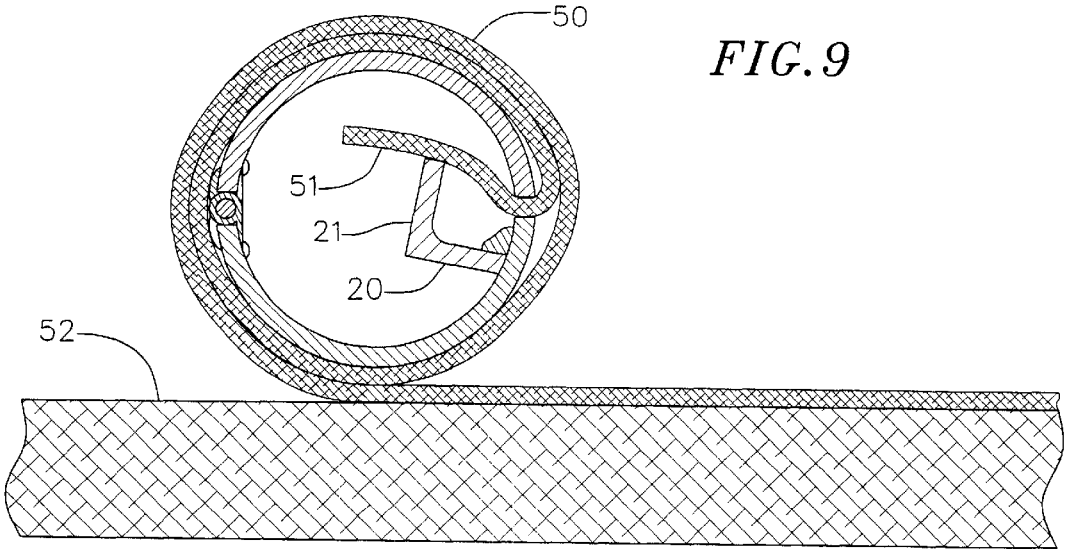
FIG. 9 is a cross sectional view of the roller with rolls of the removed floor covering on the roller in accordance with this invention.

In operation, the two parts of the tool are separated a sufficient distance to permit the insertion of the end or edge of the floor covering to be pulled up by the tool. The tool is then closed, as shown in FIG. 8, with the edge or end 51 of the floor covering 50 in the tool. The clamp 11 pushes the end 51 towards the interior surface of the first part 2 of the tool to hold the end of the floor covering in place. The roller 1 is then rolled to pull up the floor covering 50 from the substrate 52 to which it has been adhesively attached. As the roller 1 is rotated, the floor covering is pulled up and is rolled onto the roller as shown in FIG. 9.

Figure 11:
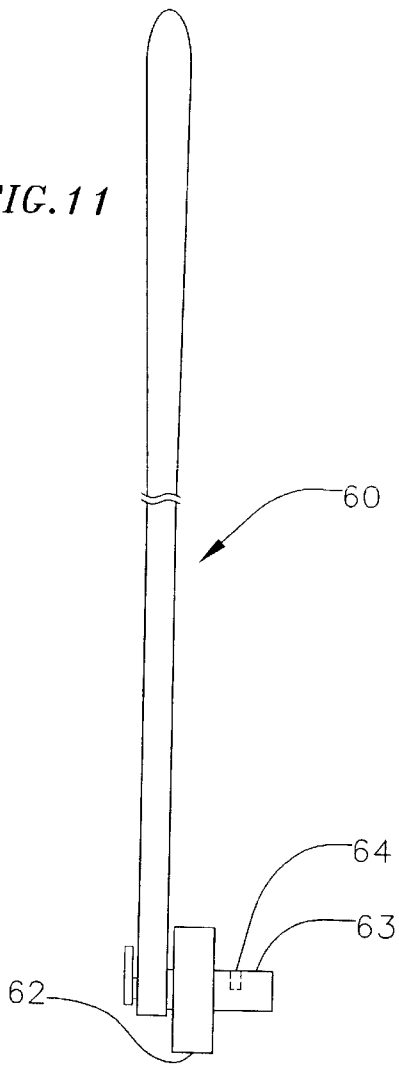
FIG. 11 is a front elevation view of the ratcheted handle of FIG. 10 in accordance with this invention.
Figure 10:
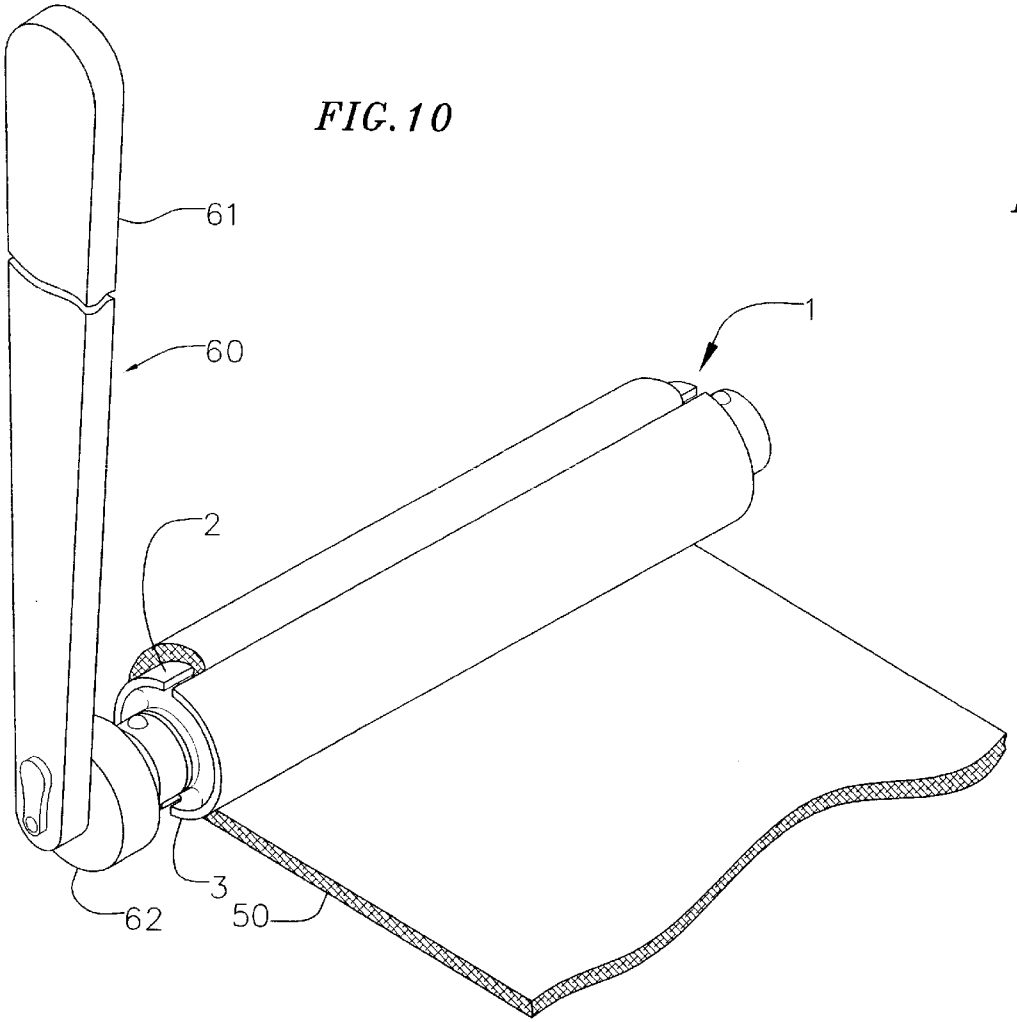
FIG. 10 is a perspective view of the roller with an end of the floor covering locked in place and a ratcheted handle for turning the roller in accordance with this invention.
Figure 12:
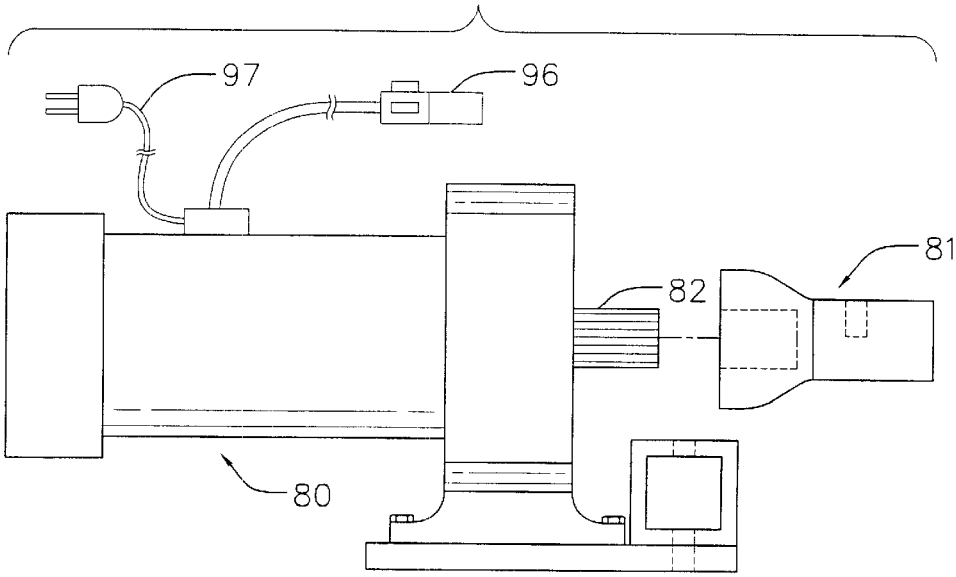
FIG. 12 is a left side elevation view of a motor and adaptor for driving the roller in accordance with this invention.
Figure 14:
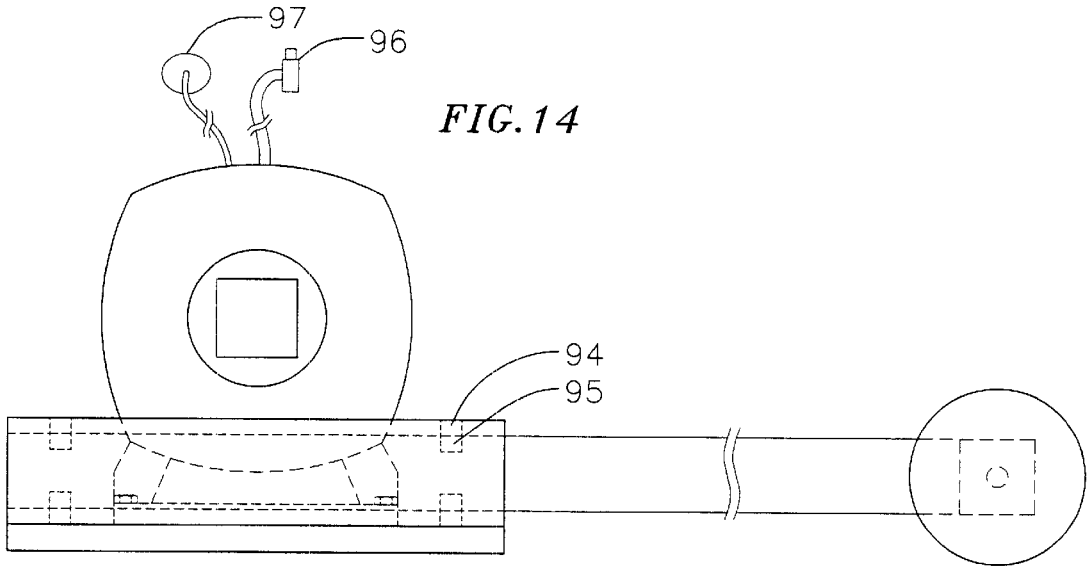
FIG. 14 is a front elevation view of the motor with a wheeled carriage in accordance with this invention.
Figure 13:
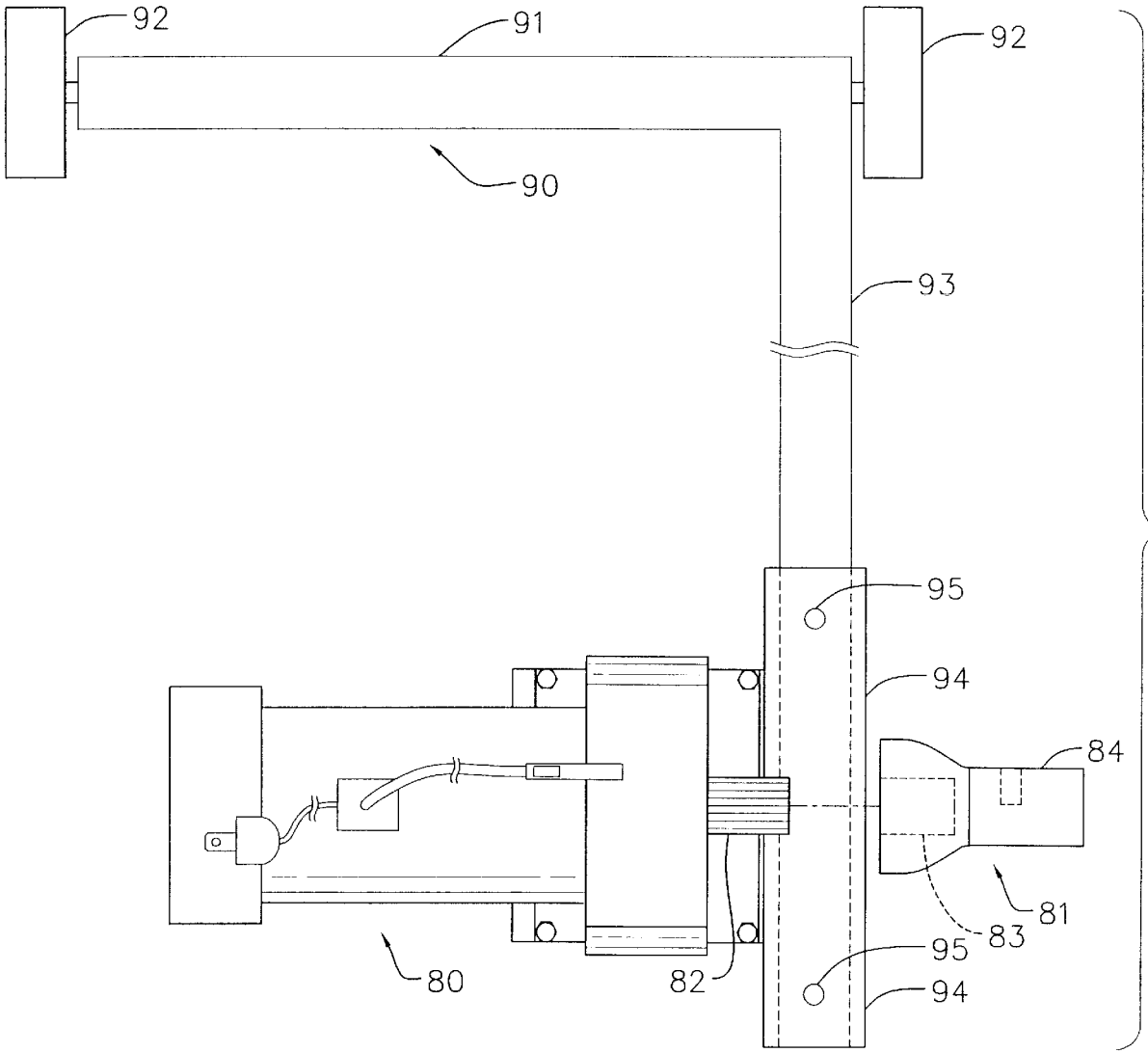
FIG. 13 is a top plan view of the motor and adaptor with a reversible roller carriage in accordance with this invention.
Figure 15:
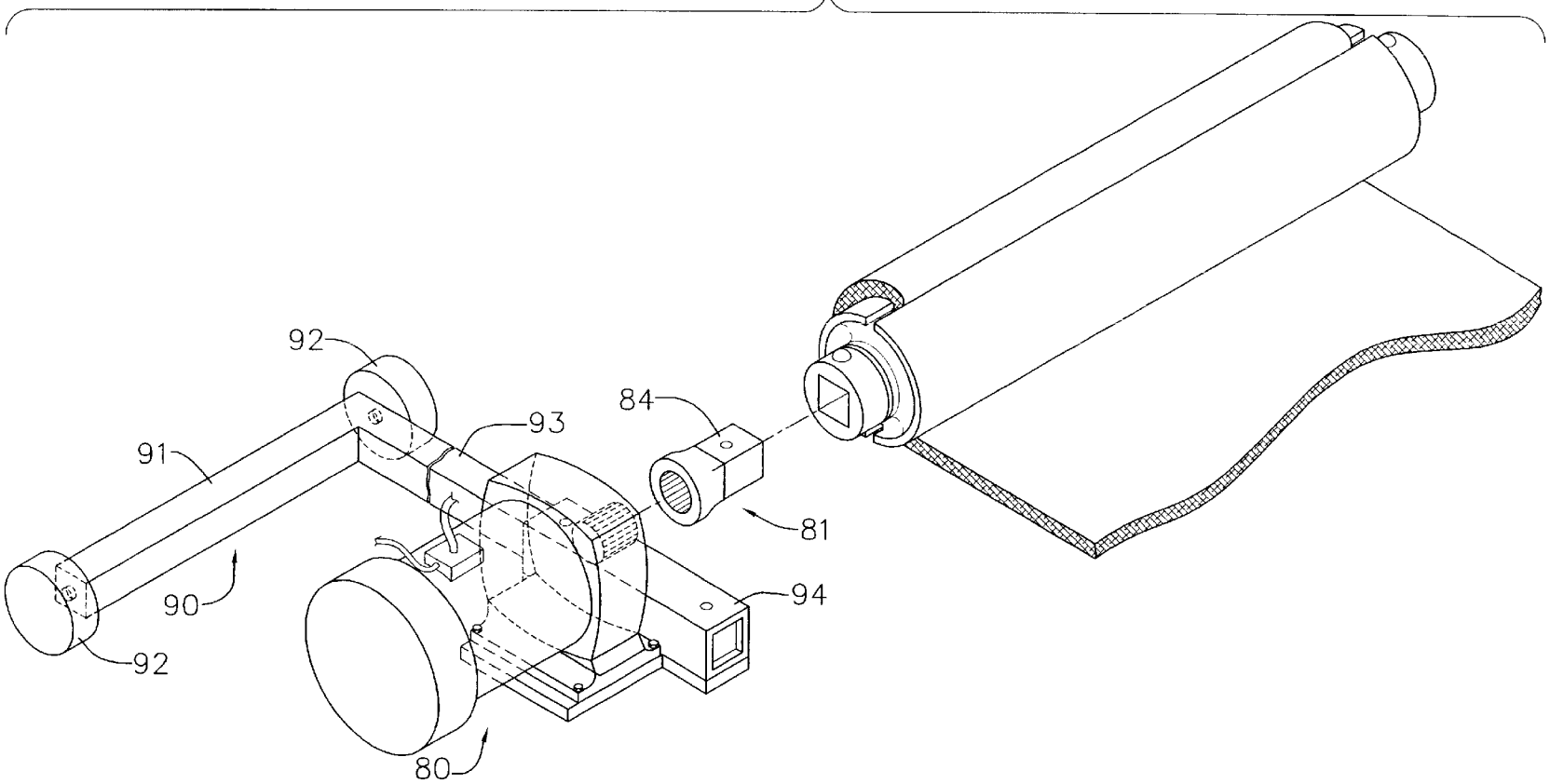
FIG. 15 is a pulled apart perspective view of the motor, adaptor and roller positioned on a centerline for assembly in accordance with this invention.

A manual drive mechanism for rotating the roller 1 is shown in FIGS. 10 and 11. The manual drive mechanism 60 includes a lever arm 61 and a ratchet housing 62 containing a typical ratcheting mechanism to permit positive drive in either direction. The manual drive mechanism 60 further includes a shaft 63 that has an external configuration that corresponds to the configuration of the hole 30 in the roller 1. The shaft 63 has an indentation or a hole 64 in which the pin 40 is inserted for holding the mechanism in position on the roller 1.

The roller may also be rotated by a motorized drive mechanism as shown in FIGS. 12 through 15. A motor 80 is coupled to the roller 1 through an adapter 81. The motor 80 may advantageously be a ⅓hp motor manufactured by Dayton and sold by Grainger. The motor is a split phase TEFC 115 volt 60-cycle motor having stock no. 6Z402. The motor shaft 82 is knurled and fits in a corresponding hole 83 of the adapter 81. Adapter 81 has a further extension of a shaft 84 that fits in the hole 30 of the roller 1.

A wheeled carriage 90 supports motor 80 on one side of the motor so that as the motor rotates the roller 1 and the roller and motor move in one direction, the wheeled carriage 90 moves with the motor 80 and supports the motor. The motor 80 is also supported at the shaft end through the adapter 81 and the roller 1. The carriage 90 has a first square bar 91 that supports a wheel 92 at each end. A second square bar 93 at a right angle to bar 91 extends into a holder 94 that is attached to the motor 80. The bar 93 has a pair of holes 95 for insertions of pins to hold the wheeled carriage in the holder 94 attached to the frame of motor 80.

A hand held switch 96 extends from the motor 80 for operation of the motor. The motor is coupled to an AC outlet through an electrical cord 97.

Figure 16:
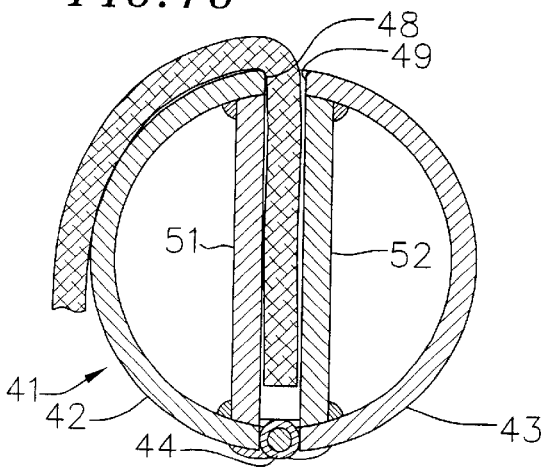
FIG. 16 is a cross-sectional view through the longitudinal center of the roller of an alternative embodiment with another device for holding the end of the floor covering to be removed in accordance with this invention.

An alternative embodiment for the roller is shown in FIG. 16. A roller 41 includes a clamp 70, for holding the end of the floor covering, such as carpet, in place for removal. The clamp consists of two longitudinal plates 71 and 72 inside the roller 41. Plate 71 extends the length of a first part 42, that is essentially one-half of a cylinder. Plate 71 is attached internally to the first part 42 near a longitudinal edge 48 along one side and is attached internally to the first part near a hinge 44 along the other side to cover the open face of the first part 42. Similarly plate 72 extends the length of a second part 43, that is essentially one-half of a cylinder. Plate 72 is attached internally to the second part 43 near a longitudinal edge 49 along one side and is attached internally to the second part near the hinge 44 along the other side to cover the open face of the second part.

The plates 71 and 72 are flat and their surfaces are essentially parallel, when the first part 42 and second part 43 are in their fully closed position, similar to the roller 1 as shown in FIGS. 1–3.

These plates may be angled in their attachment to be closer near the hinge 44 when closed or farther apart as compared to the spacing when the plates are parallel. The spacing is determined by the thickness of the floor covering such as carpet or vinyl, to be removed.

The plates are steel plates and add rigidity to the tool. As a consequence, the parts 42 and 43 may be made of lighter material than the tool of FIGS. 1–7.

The rigidity of the tool is important in operation. Some material, such as plastics, like PVC, may twist and/or break if the tool is caused to turn by force applied at only one end. A rigid tool, such as one made of a sufficiently thick metal or one having rigid partitions and a rigid outer body as shown in FIG. 16 will have minimal twist and can be caused to turn or rotate by force applied at only one end. One problem with a roller that twists is that the floor covering does not go on the roller straight, but skews and interferes with the drive mechanism.

A preferred metal is steel; but other metals, such as aluminum, if sufficiently thick to be rigid and not twist, may also be used.

Figure 17:
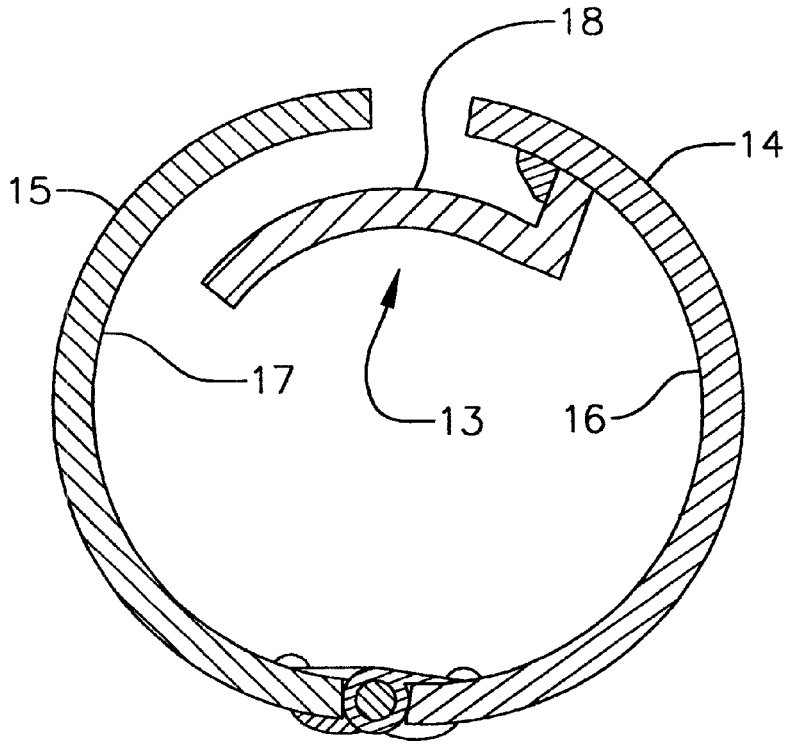
FIG. 17 is a cross-sectional view of a roller having an internal floor covering gripper that has a surface that corresponds to the internal surface of the roller.
Figure 18:
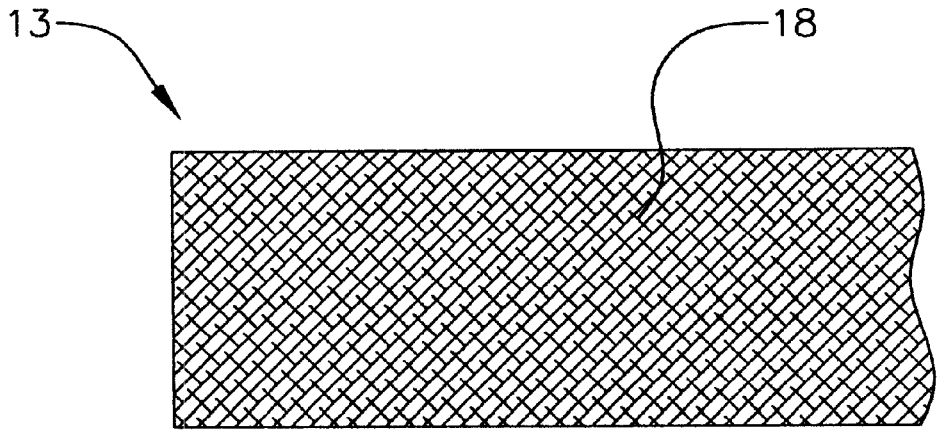
FIG. 18 is a top plan view along the longitudinal direction of the gripper of FIG. 17 showing the rough surface.

Another embodiment, shown in FIGS. 17 and 18 of the drawings, has a clamp or gripper 13 that is welded to the inside surface 16 of a first part 14. The clamp 13 has a surface 18 that is curved with a curve that matches the curve of the inside surface 17 of the second part. The curved surface 18 holds the end of the floor covering, such as carpet, between the curved surface 18 of the clamp and the inner curved surface 17 of the second part 15.

The surfaces of the clamps of the various rollers of this invention may be smooth or rough as shown in FIG. 18. Further, the clamp, such as clamps 11, 13 and 70, may not cover the full longitudinal length of the roller. For example, clamp 70 of FIG. 16 may have a plurality of flat plates 71 and 72 of short length rather than single plates that extend the full longitudinal length of roller 41.

When the plates 71 and 72 extend the full longitudinal length of the roller 41, the internal curved surfaces of parts 42 and 43 are not exposed to the glues that may adhere to the floor covering inserted in the roller. Further, the parts 42 and 43 of roller 41 may be completely sealed by separate end caps having a semi-circular shape that corresponds to the semi-circular shapes at the end of a part 42 or 43. As a consequence the roller is relatively easy to clean since only one surface of plates 71 and 72 is exposed to the glue.

The spacing between the part and the clamp or, between the surface of the holding mechanism in the roller is determined by the type and thickness of the floor covering to be removed. The spacing between plates 71 and 72 is less for vinyl, for example, than it is for carpet.

Common lengths for the roller are 1 foot, 2 feet and 4 feet. A common width for a floor covering, such as carpet, is 12 feet so that the floor covering can be cut into three four foot strips and quickly and easily pulled up by a roller that is 4 feet long. The shorter rollers, such as a 1 foot roller, is useful in removing glued down floor covering from stairs and from small or confined areas. The operation of the floor covering removal tool is the same on stairs as in larger flat areas such as a room. The end of the floor covering to be removed is inserted into the roller 1 and clamped in place by closing the two parts of the roller to form the cylindrical body and then the roller is rotated, preferably by use of the manual drive mechanism of FIGS. 10 and 11.

Although preferred embodiments of the floor covering removal tool have been shown and described above, the invention is not limited to these specific embodiments, but rather the scope of the invention is to be determined as claimed.

What is claimed is:

1. A floor covering removal tool comprising a first part and a second part coupled together by a hinge to form a roller having a substantially cylindrical body with a longitudinal opening for insertion of an end of the floor covering to be removed, means for holding the end of the floor covering in place inside the cylindrical body, a coupler at least at one end of the cylindrical body for coupling the roller to a drive mechanism to roll the roller over the floor covering to be removed so that the floor covering rolls onto the roller.

2. A floor covering removal tool in accordance with claim 1 wherein the two parts are identical and have a shape of substantially hollow half cylinders.

3. A floor covering removal tool in accordance with claim 1 wherein the parts are made of metal and one part has an angled member attached to the inside surface with a protrusion extending toward the interior surface of the other part when the two parts are closed.

4. A floor covering removal tool in accordance with claim 1 wherein one part has a curved portion that is less than one-half of a hollow cylinder while the second part has a curved surface that is greater than one-half of a hollow cylinder.

5. A floor covering removal tool of claim 1 wherein the first part and the second part are of sufficiently rigid material to prevent twisting of the roller and skewing of the floor covering on the roller.

6. A floor covering removal tool in accordance with claim 1 wherein the holding means is attached to the second part and has a surface with a curvature that is the same as the interior surface of the first part, the curved surface being spaced apart from the interior surface of the first part by a distance determined by the type and thickness of the floor covering to be removed.

7. A floor covering removal tool in accordance with claim 6 wherein the curved surface of the holding means is rough to securely grip the end of the floor covering when the parts are closed to form the cylindrical body.

8. A floor covering removal tool comprising a roller having an essentially cylindrical outer body made of sufficiently rigid material so that the roller will not twist and will not skew the floor covering on the roller as the covering is rolled onto the roller and a means for clamping an end of the floor covering inside the cylindrical body.

9. A floor covering removal tool comprising a first part and a second part coupled together by a hinge to form a roller having a substantially cylindrical body, each part having an essentially half cylindrical shape with a longitudinal open face means for holding the end of a floor covering internal of the cylindrical body, the holding means comprising a first plate attached to the first part to cover the open face of the first part and having a length nearly equal to the longitudinal length of the first part to form a partition across the first part and a second plate attached to the second part to cover the open face of the second part and having a length nearly equal to the longitudinal length of the second part to form a partition across the second part.

10. A floor covering removal tool in accordance with claim 9 wherein the material of the plates and the first and second part form a sufficiently rigid roller to minimize twisting of the roller to prevent skewing of the floor covering on the roller when the roller is driven from only one end.

* * * * *